United States Patent [19]

Bosshard et al.

[11] Patent Number: 4,611,525

[45] Date of Patent: Sep. 16, 1986

[54] CADENCE REGULATOR FOR A GAS-PRESSURE OPERATED FIRING WEAPON

[75] Inventors: Werner Bosshard, Zurich, Switzerland; Willi Schröder, Jestetten, Fed. Rep. of Germany

[73] Assignee: Werkzeugmaschinenfabrik Oerlikon-Bührle AG, Zurich, Switzerland

[21] Appl. No.: 748,556

[22] Filed: Jun. 24, 1985

[30] Foreign Application Priority Data

Jul. 3, 1984 [CH] Switzerland ..... 3187/84

[51] Int. Cl.[4] ..... F41D 5/08

[52] U.S. Cl. ..... 89/193

[58] Field of Search ..... 89/193

[56] References Cited

U.S. PATENT DOCUMENTS 3,680,434 8/1972 Muhlemann ..... 89/193

FOREIGN PATENT DOCUMENTS 1053977 3/1959 Fed. Rep. of Germany ..... 89/193

2031273 2/1971 Fed. Rep. of Germany ..... 89/193

511414 8/1971 Switzerland ..... 89/193

*Primary Examiner*—Stephen C. Bentley

*Attorney, Agent, or Firm*—Werner W. Kleeman

[57] ABSTRACT

It is necessary to provide a cadence regulator in a gas-pressure operated firing weapon, since a hot firing weapon would otherwise exhibit a cadence unacceptably greater than that of a cold firing weapon. The cadence regulator comprises two concentric tubes interconnected at one end and serving for actuating a temperature-dependent throttling member which regulates the gas-pressure by altering a throttling cross-section of a gas passage. Either only the inner tube is heated, causing it to expand more than the outer tube and to reduce the throttling cross-section, or both tubes are heated and the outer tube has a greater coefficient of expansion such that it expands more than the inner tube and increases the throttling cross-section. In the first case, the supply of gas to a gas piston is throttled and thereby diminished in pressure and in the second case, a discharge opening to the atmosphere is increased, also effectively diminishing the pressure of the supply of gas to the gas piston.

7 Claims, 2 Drawing Figures

CADENCE REGULATOR FOR A GAS-PRESSURE OPERATED FIRING WEAPON

BACKGROUND OF THE INVENTION

The present invention broadly relates to firing weapons and, more specifically, pertains to a new and improved construction of a cadence regulator for a gas-pressure operated firing weapon.

Generally speaking, the cadence regulator of the present invention is intended for a gas-pressure operated firing weapon having a temperature-dependent throttling member which regulates the gas pressure by altering the cross-section of a gas passage. The throttling member is movably arranged for altering the cross-section and is moved by regulating means.

In its more particular aspects, the inventive cadence regulator or cadence-regulating device comprises a gas passage defining a predetermined cross-section for conducting gases having a gas pressure and an elevated gas temperature from a firing barrel of the firing weapon to an actuating mechanism of the firing weapon, a movable throttling member arranged in the gas passage for regulating the gas pressure by temperature-dependently altering the predetermined cross-section of the gas passage, and regulating means for moving the throttling member.

In a cadence regulator of this type known from the Swiss Pat. No. 511,414, the regulating device comprises two members made of materials having different coefficients of expansion. The throttling member comprises a piston having a control edge and situated in a cylindrical bore. The piston is loaded on one side by a spring and is contacted on the other side by a fluid. The control edge of the piston can alter a cross-section of a gas passage. Mercury is employed as the fluid in this known cadence regulator. This known cadence regulator has the disadvantage that in time, i.e. as the firing weapon heats up, the cadence cannot be maintained constant.

SUMMARY OF THE INVENTION

Therefore, with the foregoing in mind, it is a primary object of the present invention to provide a new and improved construction of a cadence-regulating device which does not exhibit the aforementioned drawbacks and shortcomings of the prior art constructions.

Another and more specific object of the present invention aims at providing a new and improved construction of a cadence-regulating device of the previously mentioned type which is simply and reliably constructed and which prevents an impermissible increase of the firing cadence as the firing weapon heats up.

Yet another further significant object of the present invention aims at providing a new and improved construction of a cadence regulator of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the cadence-regulating device of the present invention is manifested by the features that the regulating means comprises a first tube defining a first tube end and a second tube for discharging the gases to ambient temperature and defining a second tube end, the first tube end and the second tube end being interconnected, and the first tube and the second tube differentially expanding in response to the gases being discharged through the second tube at the elevated temperature.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
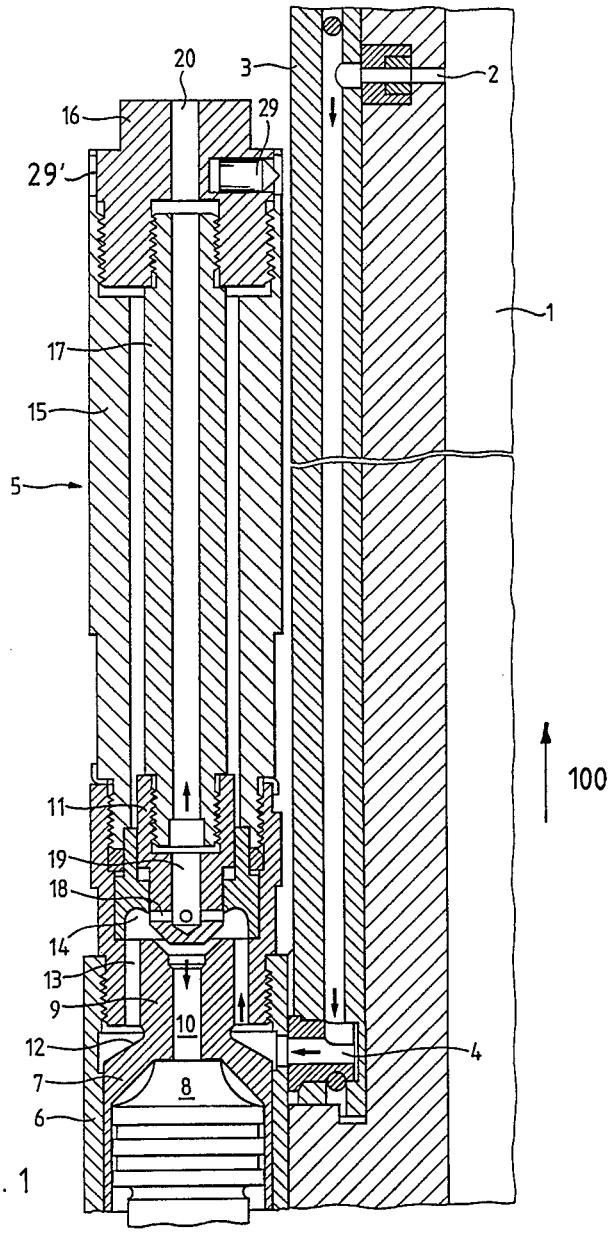
FIG. 1 schematically shows a longitudinal section through a first embodiment of the cadence regulator or cadence-regulating device of the invention mounted on a barrel of a firing weapon.

Describing now the drawings, it is to be understood that to simplify the showing thereof only enough of the structure of the cadence-regulating device has been illustrated therein as is needed to enable one skilled in the art to readily understand the underlying principles and concepts of this invention. Turning now specifically to FIG. 1 of the drawings, the apparatus illustrated therein by way of example and not limitation will be seen to comprise a weapon barrel or firing barrel 1, only a portion of which is illustrated, defining a direction of firing indicated by the arrow 100. This weapon barrel 1 is provided with a transverse bore or passage 2 which serves for gas extraction from the weapon barrel 1 and opens into a gas extraction tube 3 arranged to extend substantially parallel to the weapon barrel 1 and mounted thereupon. The gas extraction tube 3 is provided with a further transverse bore or passage 4 at its lower end in FIG. 1. This further transverse passage 4 opens into a cadence regulator or cadence-regulating device 5.

The cadence regulator or cadence-regulating device 5 and the weapon barrel 1 are mounted in a weapon housing or casing 6, only a small portion of which is shown in FIG. 1. This cadence regulator or regulating device 5 comprises a cylinder 7 in which a gas piston 8 is translatably supported. The firing weapon is actuated by the gas piston 8 in a manner known per se and therefore not illustrated or considered in detail here. After each shot in a round of consecutive shots or series firing, the gas piston 8 initiates firing of the next shot or round. The gas extracted or tapped from the weapon barrel 1 by means of the transverse passage 2, the gas extraction tube 3 and the further transverse passage 4 serves to actuate the gas piston 8. The cadence regulator 5 has the function of controlling or regulating the supply of the extracted gas to the gas piston 8.

The construction of the cadence regulator or cadence-regulating device 5 is as follows:

The cylinder 7 in which the gas piston 8 is translatably supported comprises a floor member or end wall 9 having an aperture 10. This aperture 10 is closeable or obturatable by a translatable throttling member 11. The cylinder 7 comprises an external annular groove 12 in its middle region into which the further transverse passage 4 opens. The end wall 9 of the cylinder 7 comprises a plurality of bores 13 extending parallel to the aperture 10. The bores 13 open into the external annular groove 12, on the one hand, and into an upper chamber 14, on the other hand. An outer cylindrical tube 15 is mounted at the upper end of the cylinder 7. A cap or plug 16 is screwed or threaded into the upper end of the outer cylindrical tube 15 and an inner cylindrical tube 17 is inserted into the plug 16. This inner cylindrical tube 17 is arranged concentrically with the outer cylindrical tube 15 and is situated in the interior of the outer cylindrical tube 15.

The previously mentioned throttling member 11 is fastened at the lower end of the inner cylindrical tube 17. A throttling cross-section of the gas passage between the throttling member 11 and the aperture 10 is adjustable by means of the plug 16 screwed into the outer cylindrical tube 15. The deeper the plug 16 is screwed into the outer cylindrical tube 15, the smaller the throttling cross-section becomes. The throttling member 11 has a plurality of transverse bores 18 as well as a central axial bore 19 which is arranged coaxial with the two cylindrical tubes 15 and 17. The plug 16 also has a central axial bore 20 which is arranged coaxially with the inner cylindrical tube 17. The plug 16 can be secured against inadvertent rotation by a latching or detent member 29 engaging fixation holes 29' formed in the outer cylindrical tube 15.

The operation of the cadence regulator or cadence-regulating device 5 described hereinabove is as follows:

At each shot, a portion of the hot firing gases accedes through the transverse passage 2, the gas extraction tube 3 and the further transverse passage 4 into the annular groove 12. The hot firing gases then accede from this annular groove 12 through the bores 13 into the chamber 14. The hot firing gases flow out of the chamber 14 through the transverse bores 18 and the central bore 19 into the interior of the inner cylindrical tube 17 and thence through the axial bore 20 of the plug 16 into the atmosphere, on the one hand, and flow out of the chamber 14 between the throttling member 11 and the end wall 9 through the aperture 10 and impinge upon the gas piston 8, on the other hand. The gas piston 8 is thus caused to displace or translate and initiate firing of the next shot in known manner. The hot firing gases heat up the inner cylindrical tube 17 which causes this inner cylindrical tube 17 to expand more greatly in relation to the outer cylindrical tube 15. As can be seen from FIG. 1, the throttling cross-section, i.e. the gap between the throttling member 11 and the end wall 9, is thereby reduced and less hot firing gas can flow through the aperture 10 toward the gas piston 8.

Figure 2:
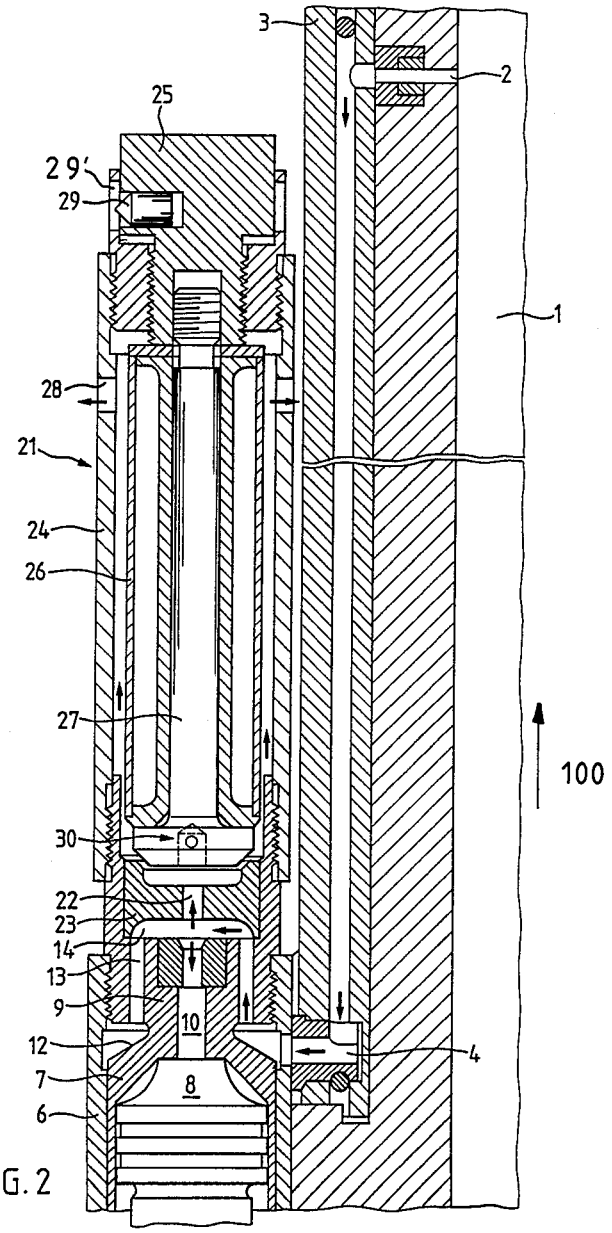
FIG. 2 schematically shows a longitudinal section through a second embodiment of the cadence regulator or cadence-regulating device of the invention mounted on a weapon barrel of a firing weapon.

Only a small portion of a weapon barrel 1 is shown in FIG. 2. This weapon barrel 1 is also provided with the transverse bore or passage 2 through which gas is extracted and which opens into the gas extraction tube 3 arranged parallel to the weapon barrel 1. The gas extraction tube 3 is provided with the further transverse bore or passage 4 at its lower end. This further transverse passage 4 opens into a cadence regulator or cadence-regulating device 21 representing a second embodiment of the invention. The cadence regulator 21 and the weapon barrel 1 are mounted in the weapon housing or casing 6, only a small portion of which is shown in FIG. 2.

The cadence regulator 21 comprises the cylinder 7 in which the gas piston 8 is translatably supported. The firing weapon is actuated by means of the gas piston 8 in a manner known per se and therefore not shown or considered in more detail here. After each shot in a round of continuous fire or series firing, the gas piston 8 initiates firing of the next shot or round. The gas extracted or tapped from the weapon barrel 1 by the transverse passage 2, the gas extraction tube 3 and the further transverse passage 4 serves to actuate the gas piston 8. The cadence regulator 21 has the function of controlling the supply of extracted gas to the gas piston 8.

The construction of the cadence regulator or cadence-regulating device 21 is as follows:

The cylinder 7 in which the gas piston 8 is translatably supported comprises the floor member or end wall 9 at its middle region. This end wall 9 has the aperture 10. The components of the cadence regulator or cadence-regulating device 21 thus far described of the second embodiment of the invention, do not differ from those corresponding components of the cadence regulator 5 previously described with reference to the first embodiment of the invention, and thus are conveniently generally designated by the same reference numerals. The cadence regulator 21 according to the second embodiment does, however, differ from the first described cadence regulator 5 by the following features.

The cylinder 7 comprises the external annular groove 12 in its middle region. The further transverse passage 4 opens into the external annular groove 12. The end wall 9 of the cylinder 7 comprises a plurality of bores 13 extending parallel to the central aperture 10. The bores 13 open into the external annular groove 12, on the one hand, and into the upper chamber 14, on the other hand. From this chamber 14, the gas can, on the one hand, freely impinge upon the gas piston 8 through the central aperture 10 and, on the other hand, flow through a bore 22 of an insert member 23 also situated in the upper chamber 14. A cylindrical outer tube 24 is fastened to the upper end of the cylinder 7 and is preferably made of aluminum. A plug 25 is screwed or threaded into the upper end of the outer cylindrical tube 24 and an inner cylindrical tube 26 is inserted into the plug 25. This inner cylindrical tube 26 is arranged concentrically with the first outer cylindrical tube 24 and is situated in the interior of the first outer cylindrical tube 24. This inner cylindrical tube 26 may, for instance, be made of steel.

A throttling member 30 is fastened by a shank 27 to the inner cylindrical tube 26 at its lower end. A throttling aperture or cross-section is present between the throttling member 30 and the insert member 23. The throttling aperture is adjustable by means of the plug 25 screwed into the outer cylindrical tube 24. The deeper the plug 25 is screwed into the outer cylindrical tube 24, the smaller the throttling aperture becomes. The gases can accede through the bore 22 of the insert member 23 through this throttling aperture or cross-section between the two cylindrical tubes 24 and 26. The outer cylindrical tube 24 is provided with discharge, exhaust or exit apertures 28 at its upper end through which the gases present between the two cylindrical tubes 24 and 26 can accede to the atmosphere. The plug 25 can be secured against inadvertent rotation by a latching or detent member 29 engaging in fixation holes 29' in the upper end of the outer cylindrical tube 24.

The operation of the cadence regulator or cadence-regulating device 21 according to the second embodiment of the invention is as follows:

At each shot, a portion of the hot firing gases accedes through the transverse passage 2, the gas extraction tube 3 and the further transverse passage 4 into the annular groove 12. The hot firing gases accede from this annular groove 12 through the bores 13 into the chamber 14. From the chamber 14, the hot firing gases flow through the central aperture 10 to impinge upon the gas piston 8, on the one hand, and flow out of the chamber 14 between the throttling member 30 and the insert member 23 and between the inner and outer cylindrical tubes 26 and 24, respectively, and through the discharge apertures 28 into the atmosphere, on the other hand.

The hot firing gases heat up both the outer cylindrical tube 24 and the inner cylindrical tube 26. Since, however, the outer cylindrical tube 24 has a greater coefficient of expansion than the inner cylindrical tube 26, the outer cylindrical tube 24 will expand more. As can be seen from FIG. 2, the throttling cross-section, i.e. the gap or aperture between the throttling member 30 and the insert member 23, increases and more of the firing gases can escape to the atmosphere.

While there are shown and described present preferred embodiments of the invention, it is to be distinctly understood that the invention is not limited thereto, but may be otherwise variously embodied and practiced within the scope of the following claims.

Accordingly, what we claim is:

1. A cadence-regulating device for a gas-pressure operated automatic firing weapon, comprising:

a gas passage defining a predetermined cross-section for conducting gases having a gas pressure and an elevated gas temperature from a weapon barrel of the firing weapon to an actuating mechanism of the firing weapon;

a movable throttling member arranged in said gas passage for regulating said gas pressure by temperature-dependently altering said predetermined cross-section of said gas passage;

regulating means for moving said throttling member;

said regulating means comprising a first tube defining a first tube end and a second tube for discharging said gases to ambient pressure and defining a second tube end;

said first tube end and said second tube end being interconnected; and said first tube and said second tube differentially expanding in response to said gases being discharged through said second tube at said elevated temperature.

2. The cadence-regulating device as defined in claim 1, wherein:

said second tube defines an inner tube;

only said inner tube discharging said gases at said elevated temperature; and only said inner tube being heated by said gases and expanding in response thereto.

3. The cadence-regulating device as defined in claim 2, wherein:

said inner tube is arranged such that said predetermined cross-section of said gas passage is decreased in area when said inner tube expands.

4. The cadence-regulating device as defined in claim 2, wherein:

said first tube and said second tube comprise the same material.

5. The cadence-regulating device as defined in claim 1, wherein:

said second tube defines an outer tube having a first coefficient of thermal expansion;

said first tube defining an inner tube having a second coefficient of thermal expansion; and said first coefficient of thermal expansion being greater than said second coefficient of thermal expansion such that said outer tube expands more than said inner tube when heated to essentially equal temperatures.

6. The cadence-regulating device as defined in claim 5, wherein:

said predetermined cross-section of said gas passage increases when said inner tube and said outer tube are heated.

7. The cadence-regulating device as defined in claim 5, wherein:

said outer tube comprises aluminum; and said inner tube comprises steel.

* * * * *